US005180164A

United States Patent [19]

Celaya

[11] Patent Number: 5,180,164

[45] Date of Patent: Jan. 19, 1993

[54] TOHITI RATTAN POLICE BATON

[76] Inventor: Richard J. Celaya, 5 Cape Ct., Monsey, N.Y. 10952

[21] Appl. No.: 783,610

[22] Filed: Oct. 28, 1991

[51] Int. Cl.[5] ..... F41B 15/02

[52] U.S. Cl. ..... 273/84 R; 482/109

[58] Field of Search ..... 273/67 R, 67 A, 67 D, 273/72 R, 73 F, 84 R, 84 ES; 272/124; 427/364, 408

[56] References Cited

U.S. PATENT DOCUMENTS

| | | | |
|---|---|---|---|
| 2,772,986 | 12/1956 | Buck | 427/408 X |
| 2,804,399 | 8/1957 | Kelley et al. | 427/408 X |
| 2,804,400 | 8/1957 | Kelley et al. | 427/408 X |
| 3,220,731 | 11/1965 | Germino | 427/408 X |
| 4,455,023 | 6/1984 | Saloom | 273/84 R |

*Primary Examiner*—V. Millin

*Assistant Examiner*—William M. Pierce

*Attorney, Agent, or Firm*—Salzman & Levy

[57] ABSTRACT

The present invention features a law enforcement search and control baton that is designed to subdue a miscreant with a minimum of force and injury to his person. The baton, which is often referred to as a "nightstick" or "policeman's billy club", comprises a base made of the core of tohiti rattan material (usually cylindrical in shape) having an approximate flexural strength in a range of between 8,800 to 10,000 psi. The high flexural strength combined with its extremely light weight of approximately between eight and eleven ounces, provides a baton with the ability to flex or bend without breaking. This in turn allows a law enforcement officer to strike a blow with less chance of fracturing bone or seriously injuring the felon.

20 Claims, 1 Drawing Sheet

TOHITI RATTAN POLICE BATON

FIELD OF THE INVENTION

The invention relates to a law enforcement search and control baton, usually referred to in the vernacular as a policeman's "nightstick", and more particularly to an improved law enforcement search and control baton comprising rattan, that is lighter in weight, stronger, and more flexible than standard batons manufactured from more conventional materials.

BACKGROUND OF THE INVENTION

In the field of law enforcement, it is desirable for the police officer or law enforcement official to carry a baton on his uniform belt. In the past standard batons have been made of wood, metal and plastics.

One of the problems with nightsticks comprising standard materials, is their rigidity and relative heaviness. Wooden batons are particularly inflexible and heavy. They often splinter, shear, or shatter when swung against rigid objects. For these reasons, most modern day batons are no longer made from wood.

Present day law enforcement standards require that a minimum of force be used to subdue criminals and scoff-laws. "Police brutality" is a very sensitive issue with police departments and minority and disadvantaged groups alike. It is not uncommon to observe apprehended criminals with massive injuries caused by insensitive and overly zealous police officers wielding nightsticks in an indiscriminate and callous manner.

Therefore, modern day batons should be somewhat flexible, so that they may render miscreants helpless without inflicting serious injury.

The nightstick should also be light, so that a minimum of strain is placed upon the uniform belt throughout the policeman's tour of duty. A standard baton weighing 23 to 32 ounces can become a tiring weight to an officer on extended patrol. In addition, a heavy police club is less useful in the search mode, where lightness and flexibility can easily translate into a sensitive feel of contraband.

While various materials have been tried for fabricating a lightweight and flexible baton, each has had its drawbacks.

The present invention reflects the discovery that rattan is a material with unusual properties that are particularly useful in the manufacture of law enforcement batons. These unusual, and specific properties of rattan have been overlooked in the past. This is mainly because rattan, which is a jungle vine, is not widely available in the Western Hemisphere. Ratta is found in the jungles of Southeastern Asia and the Philippines. The best rattan is found in Indonesia, but the export of this rare material is restricted by law in its raw, unmanufactured state.

The invention is for a police baton whose base comprises rattan of a certain variety most useful for its intended purpose. Over the rattan base, a black, composite coating is applied, to provide a smooth, professional, surface appearance. The composite coating is likewise unique, as is the rattan, since it will not chip, flake, or peel with the flexing of the nightstick.

DISCUSSION OF RELATED ART

In early days of law enforcement, nightsticks were designed to be rigid and tough. One such baton that was designed with this type of criteria is to be found in U.S. Pat. No. 365,228, issued Jun. 21, 1887. The policeman's club of this invention had a wooden base covered with leatheroid material.

The present invention is just the opposite of the policeman's club of the above-mentioned patent. Rather than aspiring to fabricate a club that is rigid and tough, the current invention has developed a baton that is light and flexible. As a result, the baton of the present invention is in keeping with the modern day needs of law enforcement agencies.

Another invention that addresses the problem of law enforcement by suggesting a club that will render unusual damage to its victim is found in U.S. Pat. No. 4,455,023, issued Jun. 19, 1984. The description in this patent likens the effects of the metal housing of the nightstick to that of brass knuckles, for the purpose of gaining additional force with each blow. Quite obviously, such a weapon is not in keeping with the purposes and objectives of the present invention. The current invention is designed to render the criminal docile and helpless with a minimum of force and injury.

SUMMARY OF THE INVENTION

In accordance with the present invention, there is provided a law enforcement search and control baton that is designed to subdue a miscreant with a minimum of force and injury to his person. The baton, which is often referred to as a "nightstick" or "policeman's billy club", comprises a base of rattan material (usually cylindrical in shape) having an approximate flexural strength in a range of between 8,800 to 10,000 psi, when an applied force is applied to a mid-portion, with the ends restrained. The high flexural strength combined with its extremely light weight of approximately between eight and eleven ounces, provides the baton with the ability to flex or bend without breaking. This in turn allows a law enforcement officer to strike a blow with less chance of fracturing bone or seriously injuring the felon. The baton is approximately between 0.9 and 1.2 inches in diameter, and approximately between eighteen to thirty-six inches in length (preferably twenty-six inches in length). The invention is far lighter than conventional, present day police batons of approximately 23 to 32 ounces. This exceptional light weight additionally makes the nightstick easy to carry upon one's person, and provides unusual sensitivity in ferreting out contraband in the search mode. The rattan base is overlaid with a composite coating that provides the nightstick with a smooth and lustrous, black surface appearance. The coating is designed to provide a good gripping strength when the palm is sweaty or when the handle is wet. The composite coating is unique in that it will not chip, crack, flake or peel, even when the nightstick is bent in an arc of approximately 180°, or when the nightstick is highly impacted. The coating comprises a first layer of a sealer that is overcoated with a second layer of black, Indonesian paint, called Rogathan Black Matt. Over the first two layers, a third coat of material is applied comprising a base of melamine epoxy overcoated with nitrocellulose.

DESCRIPTION OF THE PREFERRED EMBODIMENT

Figure 1:
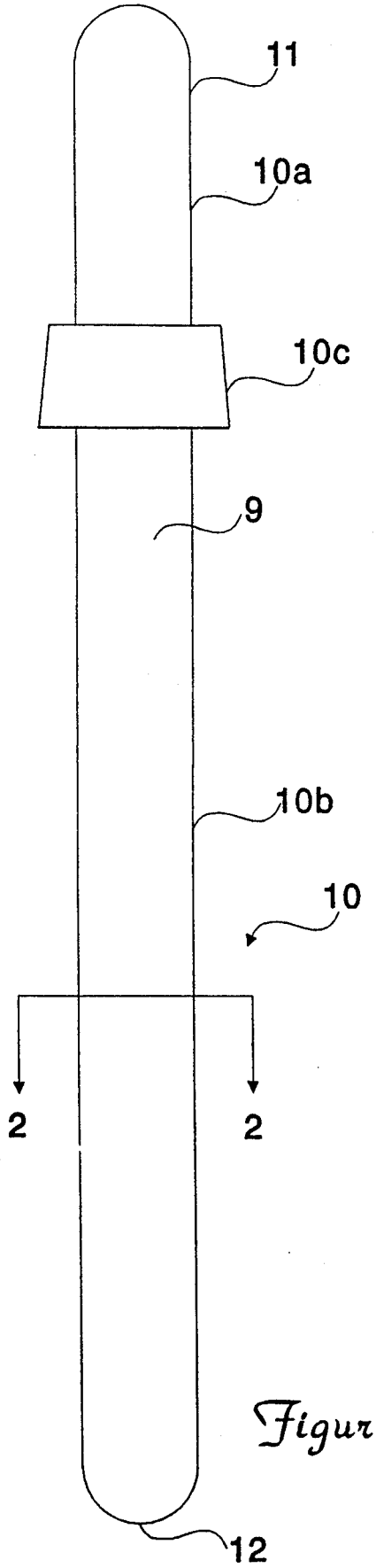
FIG. 1 illustrates a front view of the baton of this invention.

The present invention features a lightweight, flexible, search and control baton useful in law enforcement. The nightstick of the invention comprises a base made of rattan, a jungle vine autochthonous to Southeast Asia. In particular, the rattan used in the invention is a rattan species known as "tohiti", which grows mainly in the jungles of Indonesia on an island called Cerebon. The tohiti vine comprises a tough outer skin which is stripped away to reveal a central core. The core is cut into the required baton lengths of approximately 26 inches (typical) and widths of approximately 0.9 to 1.2 inches in diameter. The core is shaped into a cylindrical body having a handle portion 10*a* and a club portion 10*b*, as shown in FIG. 1. The body comprises ends 11 and 12 respectively to provide a baton architecture.

While the central core of the other species of rattan vine is usually much weaker than the integral vine, this is not the case for the tohiti species. This invention reflects the discovery that the central core of the tohiti is actually the strongest part of the vine, thus making it ideal for manufacturing the baton of this invention.

Figure 2:
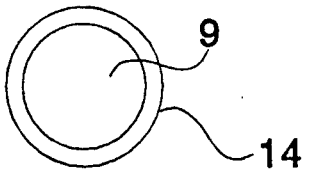
FIG. 2 depicts a sectional view of FIG. 1, as taken along lines 2—2 thereof.

The rattan core 9 is overlaid with a resilient, composite coating 14, as shown in FIG. 2, comprising a first coating of nitrocellulose primary grey or black consisting of Rogamine sanding sealer, formula No. I F 506-04SS/916; a layer of pyroxylin lacquer putty; a layer consisting of Rogathan Black Matt, a black paint common in Indonesia for painting rattan furniture, having the formula No. I F 537-977 M; a layer comprising a base coat of melamine epoxy overlaid with three layers of nitrocellulose lacquer coating, applied under air pressure of 2.5-3.5 kg/cm$^2$ and dried for 2 hrs.

The above-mentioned coating provides a black satin finish to the nightstick that will not peel, chip, flake, or crack with flexure or high impact loadings.

The baton of this invention may be provided with a rubber handle 10*c*, as shown in FIG. 1, or grip portion which can be used as a stop when inserted an officer's belt.

Several sample batons were fabricated in accordance with the above description and tested for tensile strength compressive strength, and flexural strength in accordance with the following examples:

EXAMPLE 1

Flat test specimens were machined from the nightsticks and tested for tensile strength in an Instron Universal Testing Machine. The crosshead speed was 0.2 inches per minute. The results of this test are presented in Table 1, below:

TABLE 1

| Sample | Width(inches) | Thickness(inches) | Tensile St. (psi) |
|---|---|---|---|
| 1 | 0.514 | 0.205 | 6,640 |
| 2 | 0.510 | 0.216 | 6,580 |
| 3 | 0.506 | 0.232 | 6,680 |

EXAMPLE 2:

Several test specimens of approximately one inch in length were cut from the nightsticks and tested for compressive strength. The specimens were tested on a Baldwin-Emery Universal Testing Machine. The crosshead speed was 0.05 inches per minute. The results of this test are presented in Table 2, below:

TABLE 2

| Sample | Height(inches) | Diam.(inches) | Compressive St. (psi) |
|---|---|---|---|
| 1 | 1.050 | 1.015 | 4,970 |
| 2 | 1.040 | 1.014 | 5,080 |
| 3 | 1.025 | 1.016 | 6,680 |

EXAMPLE 3

Three night sticks were tested for flexural strength in lengths of 20 inches on an Instron Universal Testing Machine. Each baton was supported at each end, while an increasing load was applied to a mid-portion until failure occurred. The crosshead speed was 0.5 inches per minute. The results of this test are illustrated in Table 3, below:

TABLE 3

| Sample | Span(inches) | Diam.(inches) | Flexural St. (psi) |
|---|---|---|---|
| 1 | 16 | 1.095 | 8,850 |
| 2 | 16 | 1.030 | 9,880 |
| 3 | 16 | 1.112 | 9,540 |

It will be evident from the above test results that the rattan baton is far more flexible than wooden or plastic batons of the same size.

Since other modifications and changes varied to fit particular operating requirements and environments will be apparent to those skilled in the art the invention is not considered limited to the example chosen for purposes of disclosure, and covers all changes and modifications which do not constitute departures from the true spirit and scope of this invention.

Having thus described the current invention, what is desired to be protected by Letters Patent is presented by the subsequently appended claims.

What is claimed is:

1. A law enforcement baton having high flexural strength and light weight made from tohiti rattan having a core and an outer skin, comprising:

an elongated member comprising a base of rattan material and comprising essentially only the core of tohiti rattan having a composite coating thereon, and having an approximate length ranging between eighteen and thirty-six inches, a diameter in a range of approximately 0.9 to 1.2 inches, and having an approximate weight in a range from 8 to 11 ounces.

2. The law enforcement baton of claim 1, further comprising a resilient coating disposed over said base.

3. The law enforcement baton of claim 2, wherein said resilient coating comprises a composite of several layers of coating materials.

4. The law enforcement baton of claim 3, wherein said composite comprises a first sealing layer overcoating said base, a second paint layer overlaid upon said first sealing layer, and a third layer disposed over said second paint layer and comprising a base coat of epoxy overlaid with a finish coat of nitrocellulose.

5. The law enforcement baton of claim 4, wherein said epoxy of s id third layer comprises a melamine epoxy.

6. The law enforcement baton of claim 1, wherein said elongated member is approximately cylindrically shaped.

7. The law enforcement baton of claim 1, wherein said elongated member further comprises a grip portion.

8. The law enforcement baton of claim 1, wherein said elongated member is rounded at its ends.

9. The law enforcement baton of claim 1, having an approximate flexural strength in a range of between 8,800 and 10,000 psi.

10. A law enforcement baton having high flexural strength and light weight made from tohiti rattan having a core and an outer skin, comprising:

an elongated member comprising a base of rattan material comprising the core of tohiti rattan having a composite coating thereon and having an approximate weight in a range from 8 to 11 ounces, and characterized by a flexural strength exceeding 8,000 psi.

11. The law enforcement baton of claim 10, wherein said elongated member has a diameter of approximately one inch.

12. The law enforcement baton of claim 10, further comprising a resilient coating disposed over said base.

13. The law enforcement baton of claim 12, wherein said resilient coating comprises a composite of several layers of coating materials.

14. The law enforcement baton of claim 13, wherein said composite comprises a first sealing layer overcoating said base, a second paint layer overlaid upon said first sealing layer, and a third layer disposed over said second paint layer and comprising a base coat of epoxy overlaid with a finish coat of nitrocellulose.

15. The law enforcement baton of claim 14, wherein said epoxy of said third layer comprises a melamine epoxy.

16. The law enforcement baton of claim 10, wherein said elongated member is approximately cylindrically shaped.

17. The law enforcement baton of claim 10, wherein said elongated member further comprises a grip portion.

18. The law enforcement baton of claim 10, wherein said elongated member is rounded at one of its ends.

19. The law enforcement baton of claim 10, having an approximate flexual strength in a range of between 8,800 and 10,000 psi 20. A law enforcement baton having high flexural strength and light weight made from tohiti rattan having a core and an outer skin, comprising:

an elongated member comprising a base of rattan material comprising only the core of tohiti rattan having a coating therein, the outer skin of which has been stripped away.

* * * * *